United States Patent [19]

Leinoff et al.

[11] 4,003,427

[45] Jan. 18, 1977

[54] HEAT PIPE FABRICATION

[75] Inventors: Sidney Leinoff, Plainview; Frederick Edelstein, Hauppauge; Walter Combs, Freeport, all of N.Y.

[73] Assignee: Grumman Aerospace Corporation, Bethpage, N.Y.

[22] Filed: Oct. 15, 1974

[21] Appl. No.: 514,923

[52] U.S. Cl. ..... 165/105; 29/157.3 R
[51] Int. Cl.[2] ..... F28D 15/00
[58] Field of Search ..... 165/105; 29/157.3 R

[56] References Cited

UNITED STATES PATENTS

| | | | |
|---|---|---|---|
| 3,604,504 | 9/1971 | Kessler, Jr. et al. | 165/105 |
| 3,901,311 | 8/1975 | Kosson et al. | 165/105 |

*Primary Examiner*—Albert W. Davis, Jr.
*Attorney, Agent, or Firm*—Morgan, Finnegan, Pine, Foley & Lee

[57] ABSTRACT

A heat pipe is disclosed which is fabricated with an artery arranged so that the warp and weave of the wire mesh are at about a 45° angle with respect to the axis of the heat pipe.

4 Claims, 3 Drawing Figures

HEAT PIPE FABRICATION

This invention provides a novel heat pipe having a wire mesh artery constructed so that the warp and weave of the wire mesh layers are about at a 45° angle to the axis of the heat pipe.

BACKGROUND OF THE INVENTION

Heat pipes are known which are constructed of wire mesh arteries.

In U.S. Pat. No. 3,604,504 there is disclosed a wick structure that is not a composite spirally wound artery as it is shown to have a maximum of two wraps of wire mesh placed around the walls of the heat pipe, and it is not supported by legs. This prior art wicked heat pipe is not an arterial heat pipe.

It has now been found that an improved arterial heat pipe may be made with a multilayered spiral artery that is formed from bias cut wire mesh and fabricated with spacers between the layers of wire mesh.

Accordingly, it is a primary object of this invention to provide an improved heat pipe having an artery that is flexible and facilitates the fabrication of a curved heat pipe.

It is also an object to provide an improved heat pipe artery that has a high capacity and is of flexible construction.

SUMMARY OF THE INVENTION

The novel heat pipe of this invention comprises a closed casing having a wall capillary, a vaporizable liquid carried therein and a supported axially disposed artery that has at least two wire mesh layers. The wire mesh layers are spaced from one another and are arranged so that the warp 2 and weave 4 of said wire mesh 6 are at about a 45° angle with respect to the longitudinal axis of the artery. The wire mesh layers are separated by spacing means 8 which maintain spacing between the layers at predetermined dimensions.

DETAILED DESCRIPTION OF THE INVENTION

Figure 1:
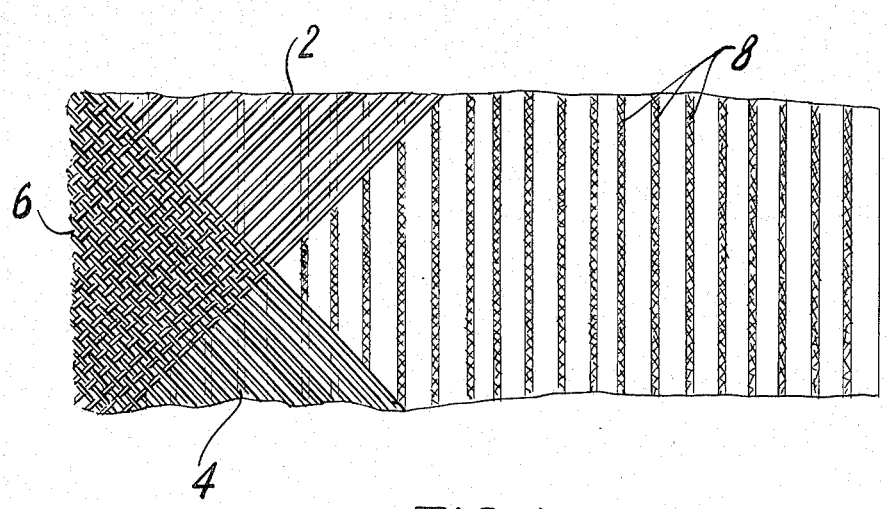
FIG. 1 is a flat section of bias cut wire mesh that has been provided with wire mesh spacer strips.
Figure 2:
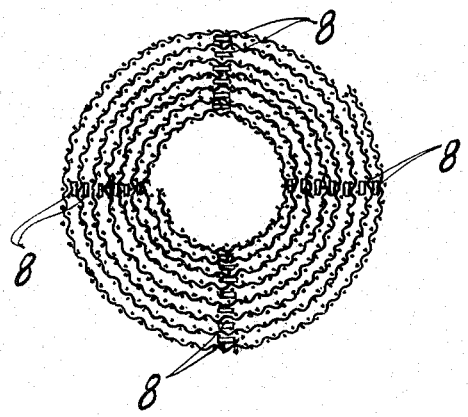
FIG. 2 is a cross-sectional view of a wire mesh artery according to the present invention.
Figure 3:
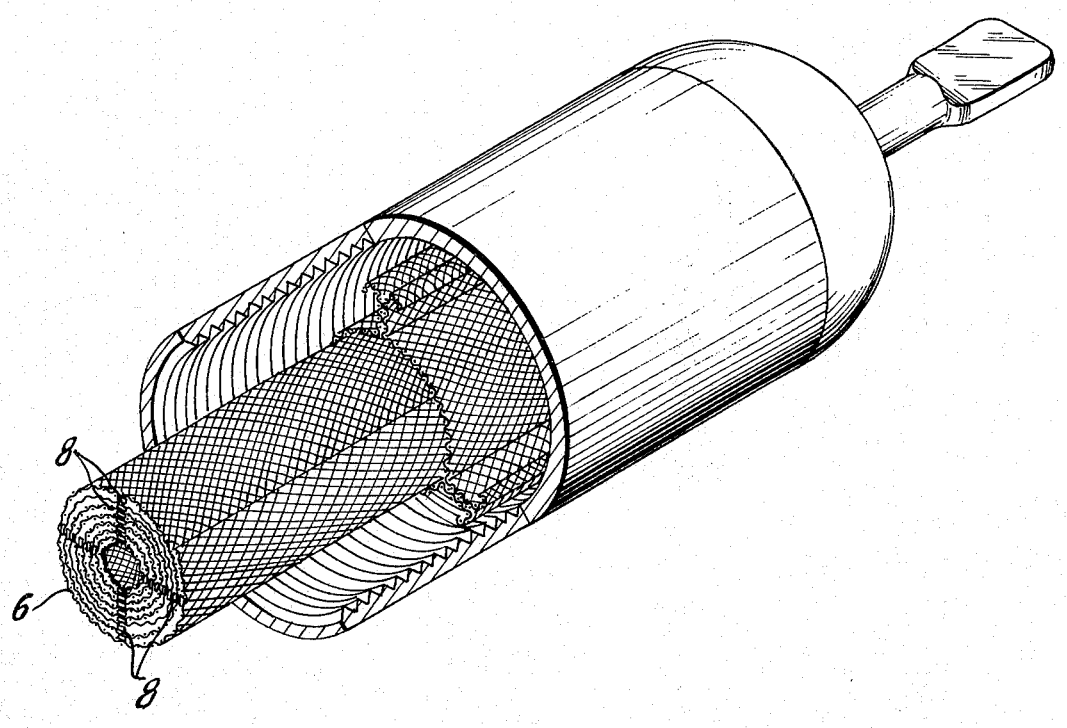
FIG. 3 is a cut-away view of a heat pipe having a casing, a wall capillary end support means for the artery.

The novel heat pipe of the invention comprises a closed casing with a vaporizable liquid therein, a wall capillary, an axially disposed artery, said axially disposed artery comprising an artery having at least two wire mesh layers, said wire mesh layers being spaced from one another and arranged so that the warp and weave of said wire mesh are at about a 45° angle with respect to the axis of said artery.

The preferred casing has a tubular cross-section although other configurations may be employed. The capillary may be a brazed screen or liner that is affixed to the internal wall or it may be a spiral groove which is cut or etched into the wall of the heat pipe. The grooves may also be a series of unconnected grooves which extend around the internal wall of the heat pipe. If a grooved wall capillary is employed, the grooves may be spaced so that there are 60 to about 300 per inch, preferably about 250 per inch. These grooves are cut about 0.0015 inch – 0.0075 inch wide.

A typical artery according to this invention may have an internal space with 1–20% of the total cross-sectional area of the heat pipe. The spacing means which separate the layers will be sized to achieve a layer separation of about 0.005 inch to about 0.020. The artery may be fabricated by bias cutting a wire mesh screen and thereafter affixing or embossing spacing means to the surface of the wire mesh screen.

The wire mesh layers may be spirally wound around appropriate spacing means or they may be fabricated from spaced concentric layers of wire mesh screening. The spacer means may be round, square, oval or rectangular elongated rods. It is also contemplated that elevated points at spaced intervals may be used as spacing means. These elevated points may be in the form of dimples that are formed by deformation of the screen material itself or are applied by bolting, welding, soldering or adhesively bonding an appropriate metal, plastic or other suitable type of material to the surface of screen. Alternate preferred spacing means may comprise strips of screening that may be bias cut and affixed to the surface of the screen mesh prior to forming a spirally wrapped artery.

These strips are preferably spot welded to the surface of wire mesh screening so that the warp and weave of the strips are substantially parallel to the warp and weave of the wire mesh screening. Mesh sizes (U.S. Standard mesh) in the order of about 50 to about 350 mesh, preferably about 100 mesh, may be used depending on the particular vaporizable liquid.

An alternate method of providing an artery having wire mesh layers at about a 45° or larger angle to the longitudinal axis is to fabricate an annular braided assembly of a plurality of coaxial braided layers that are spaced by wires that are spirally wrapped around each braided layer. The braided assembly may be made from braided layers that are made with machines using single or multiple wires per bobbin depending on the number of bobbins available on the braiding machine and the diameter of the braided layer. A plain weave or a dutch weave, i.e., each wire crosses over and goes under two wires, may be employed.

The artery is supported or held in place in the artery by a plurality of radially disposed legs or webs that will space the artery at approximately equal distances from the internal surfaces of the heat pipe although the spacing distance is not critical. These legs may be made of screening or of large diameter wire or tubing and will preferably extend along the entire length of the artery.

The heat pipe may have a casing which has a linear configuration or one that has a curved configuration. As noted above, the novel heat pipe artery of this invention is especially adapted for use in a curved heat pipe and is primarily intended to facilitate the fabrication of curved heat pipes by permitting a linear heat pipe to be bent to the desired shape after it has been assembled. In some applications, there is a requirement for a heat pipe that can, without degradation of performance, be flexed in operation.

The invention also includes a method of making a self-supporting flexible heat pipe artery. This method comprises fabricating an annular assembly with at least two wire mesh layers, said wire mesh layers being spaced from one another and arranged so that the warp and weave of said wire mesh are at about a 45° angle with the longitudinal axis of said artery and, thereafter, affixing to said annular assembly a plurality of support legs. The legs may be formed from a layer of mesh screening that is formed into a sleeve having radially projecting folds that extend from the sleeve to engage the interior of a heat pipe.

DESCRIPTION OF THE PREFERRED EMBODIMENT

A section of flat 100 mesh stainless steel wire mesh for a 26 inches long ⅝ inch heat pipe casing was cut on a 45° bias and provided with 0.090 inch wide strips of 100 mesh 45° bias cut spacers that were spot welded to the flat section of wire mesh. The artery was rolled, sealed and tilt tested. The tilt test indicated a capillary rise capability of 5¼ inches in acetone. The tunnel I.D. and the artery O.D. were 0.06 inch and 0.29 inch respectively.

Three legged 100 mesh retainers 8 inches long were fabricated for the straight evaporator and condenser sections. Two three legged ½ inch bands were used to support the artery in the 8 inches adiabatic section. The retainer legs were made into a curled pull-in design. The casing or heat pipe shell was a 26 inches internally threaded tube having a ⅝ inch O.D., 0.065 inch wall having 80 grooves per inch. After the artery was inserted into the pipe, hemispherical caps were formed on both ends of the pipe by spinning. The condenser end was fitted with a 3/16 inch pinch off tube to which a valve was attached. The evaporator end was plug welded to seal the casing.

After bake out, the pipe was charged with ammonia and tested. The charge of ammonia was removed to make the first 90° 1.875 inches R bend in the pipe. The pipe was then tested and bent to the full 180° 1.875 inches R U configuration while charged. After each bend the position of the artery in the bent section was examined by X-ray and although a slight shift was noted, the artery remained functional.

A pipe title of 1 inch (evaporator above condenser) was used as a check point for all configurations, straight, L and U. A Q max which was greater than 450 watts but less than 490 watts was observed for all three configurations.

Obviously, other modifications and variations of the present invention are possible in the light of the above teachings. It is, therefore, to be understood that changes may be made in the particular embodiments of the invention described which are within the full intended scope of the invention as defined by the appended claims.

We claim:

1. In a heat pipe having a closed casing, a wall capillary with a vaporizable liquid carried therein, and an axially disposed artery, the improvement which comprises a spirally wound supported artery having at least two wire mesh layers, said wire mesh layers being arranged so that the warp and weave of said wire mesh are at about a 45° angle with respect to the longitudinal axis of said artery, said wire mesh layers being spaced from one another by a plurality of strips of wire mesh spacers that are arranged so that the warp and weave of said strips of wire mesh spacers are substantially parallel to the warp and weave of the wire mesh of said spirally wound supported artery.

2. The heat pipe of claim 1 wherein said strips of wire mesh spacers are welded to the wire mesh of said spirally wound artery.

3. The heat pipe of claim 1 wherein said heat pipe has a straight configuration.

4. The heat pipe of claim 1 wherein said heat pipe has a curved configuration.

* * * * *